US007857742B2

(12) United States Patent
Wang

(10) Patent No.: US 7,857,742 B2
(45) Date of Patent: Dec. 28, 2010

(54) HIP TRAINING APPARATUS

(76) Inventor: Shao-Hua Wang, P.O. Box No. 6-57, Junghe, Taipei 235 (TW)

( * ) Notice: Subject to any disclaimer, the term of this patent is extended or adjusted under 35 U.S.C. 154(b) by 34 days.

(21) Appl. No.: 12/078,536

(22) Filed: Apr. 1, 2008

(65) Prior Publication Data

US 2009/0156378 A1 Jun. 18, 2009

(30) Foreign Application Priority Data

Dec. 13, 2007 (TW) ..... 96221195 U

(51) Int. Cl.
*A63B 21/00* (2006.01)
*A63B 21/045* (2006.01)
*A63B 22/14* (2006.01)

(52) U.S. Cl. ..... 482/147; 482/127; 482/138

(58) Field of Classification Search ..... 482/51–52, 482/71, 79–80, 121, 123, 130, 133–136, 482/138; *A63B 21/00, 21/045, 22/00*
See application file for complete search history.

(56) References Cited

U.S. PATENT DOCUMENTS 3,531,110 A * 9/1970 Frederick ..... 482/71
3,575,412 A * 4/1971 Arsenian et al. ..... 482/71
3,582,066 A * 6/1971 Keryluk ..... 482/71
4,650,427 A * 3/1987 Huchinson ..... 440/55
4,998,720 A * 3/1991 Kim ..... 482/130
5,496,239 A * 3/1996 Kallman et al. ..... 482/71
5,911,650 A * 6/1999 Cox ..... 482/70
6,824,500 B2 11/2004 Part et al. ..... 482/51
2006/0276308 A1* 12/2006 Wang ..... 482/79
2007/0087920 A1* 4/2007 Dachraoui et al. ..... 482/123

* cited by examiner

*Primary Examiner*—Kevin C Sirmons
*Assistant Examiner*—Oren Ginsberg
(74) *Attorney, Agent, or Firm*—Muncy, Geissler, Olds & Lowe, PLLC

(57) ABSTRACT

A "hip training apparatus" comprises a chassis and a pair of pivotable treadles. At breech of deck cover on said chassis, one ramp is formed at each left and right side descending from central line outwards laterally such that one curved trough with curved track therein is configured at each ramp. Said pivotable treadle, whose front end of back side is set in the chassis, has a roller disposed at rear end of back side thereof. At front rim of chassis, a carrying handle is built on deck cover with an aperture and two lateral slits are configured thereon for having an elastic strap passed inside so that user can arbitrarily perform stretch and twist physical exercise with entire body in balance manner. Meanwhile, by adjusting wing nut acting on the elastic belt, the torsional tension of two pivotable treadles is arbitrarily altered.

7 Claims, 10 Drawing Sheets

HIP TRAINING APPARATUS

BACKGROUND OF THE INVENTION a) Field of the Invention

The present invention is to provide a "hip training apparatus", particularly for one that employs contracting exercise of legs for activating the hip movement so as to achieve the hip training effect.

b) Description of the Prior Art

To have a physical figure with a pair of elastic beautiful legs in slender manner together with sex-appealing hips in elevated and well-rounded contour is always coveted by most of women friends. However, for those white-collar people of stationary jobs, who are confined by the office desk or computer table, may get fat on the hips and legs because assimilate too much animal-based fat cumulated in lower extremities other than lack of physical exercises to become distressed look in clumsy fatness due to accumulation of too much flesh on the hips and legs. The best way to improve such distressed look is physical exercise. For people living in the current jungle-like city, who are hindered by the limited time and space, the best way to do physical exercise is do it at home.

Currently, the physical training apparatus pinpointed on hips are always too bulky in structure and difficult to collect. For prior art of U.S. Pat. No. 6,824,500B2, neither the exterior appearance has esthetical sensibility with complicated structure nor the stretch of entire body is capable with physical balance. That proves the conventional athletic apparatus aforesaid are not good contrivances with many existing drawbacks, which become the critical issues to be urgently improved and solved. In view of suck facts and derivative issues mentioned above, the applicant of the present invention is eager to solve them by painstaking study and research as well as development for many years. Eventually, the contrivance of the present invention is successfully created.

SUMMARY OF THE INVENTION

The purpose of the present invention is to provide a "hip training apparatus" so as to contract the hips by means of leg movement, which comprises a chassis and a pair of pivotable treadle, which is interlocked with an elastic belt adjusting mechanism in the chassis. Said pivotable treadle, whose front end of back side is set in the chassis, has a roller disposed at its rear end of back side thereof. Thereby, each pivotable treadle can do pivotal movement in ascending inwards back and forth manner in each corresponding prefabricated curved track of the curved trough on the deck cover. Besides, at the heel holding position of the rear end around each said pivotable treadle, an arched heel aligning ledge is erected for enabling the user to perform inwards pressing exercise by two feet other than prevention from falling down. Moreover, the adjusting wing nut on the chassis is served to adjust the torsional tension of two pivotable treadles. By means of such elastic belt adjusting mechanism, the torsional tension exerting on two pivotable treadles is arbitrarily altered at user's will in gradient manner accordingly in accordance with various requirements of different users.

The primary object of the present invention is to provide a "hip training apparatus" having a spring cushion disposed between the sole of the pivotable treadle and the roller to offer buffer function so that the athletic injure to the exerciser can be avoided.

Another object of the present invention is to provide a "hip training apparatus" having plural nipple studs and arched heel aligning ledge disposed so that the user of different size and shape in human sole can stably stand thereon for properly performing exercise to achieve the hip training effect and purpose.

The other object of the present invention is to provide a "hip training apparatus" having a stretchable elastic strap supplied so that the user can arbitrarily perform stretch and twist physical exercise with entire body in balance manner at will.

DETAILED DESCRIPTION OF THE PREFERRED EMBODIMENTS

Figure 1:
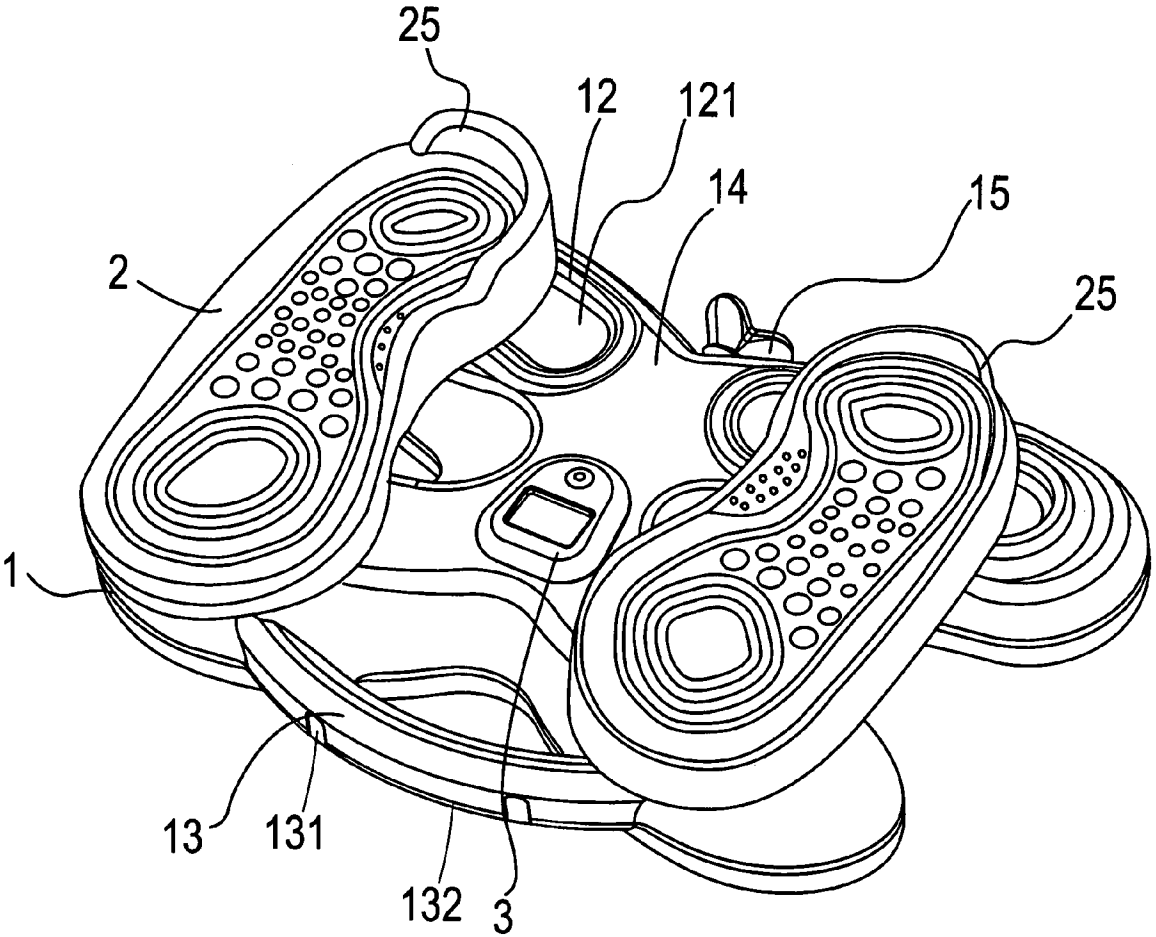
FIG. 1 is the perspective view of external shape for the present invention.
Figure 2:
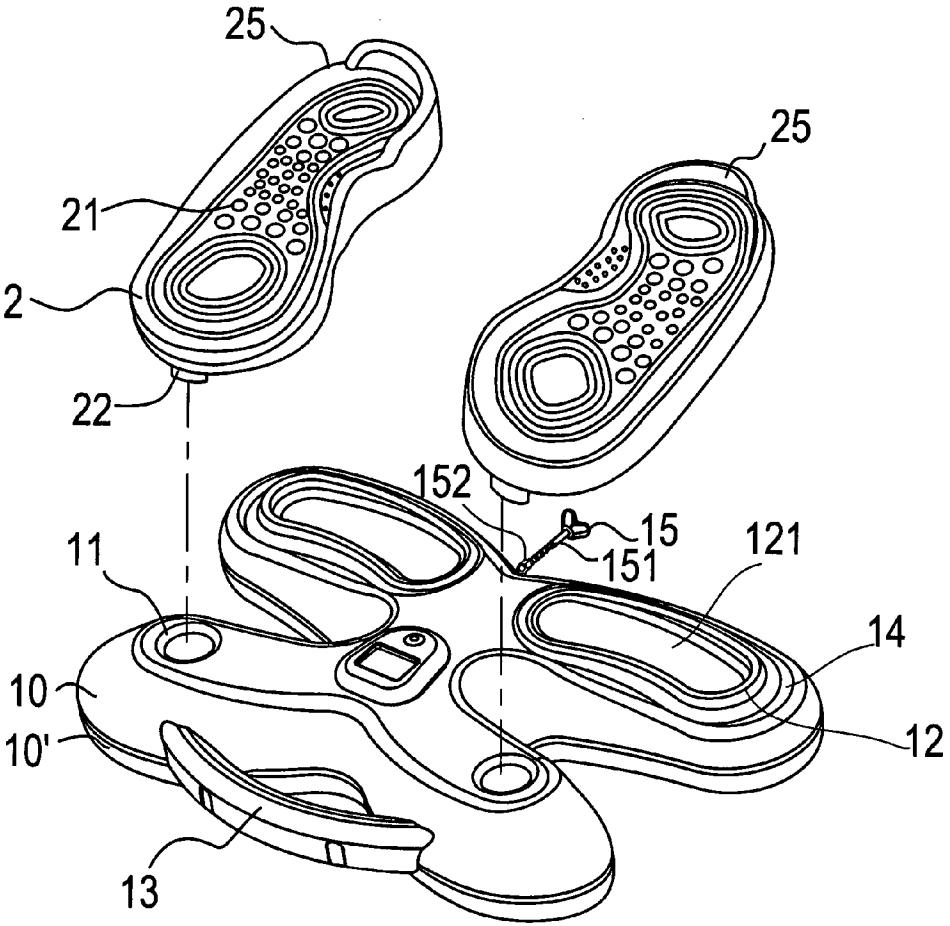
FIG. 2 is the exploded illustrative view of primary parts for the present invention.
Figure 3:
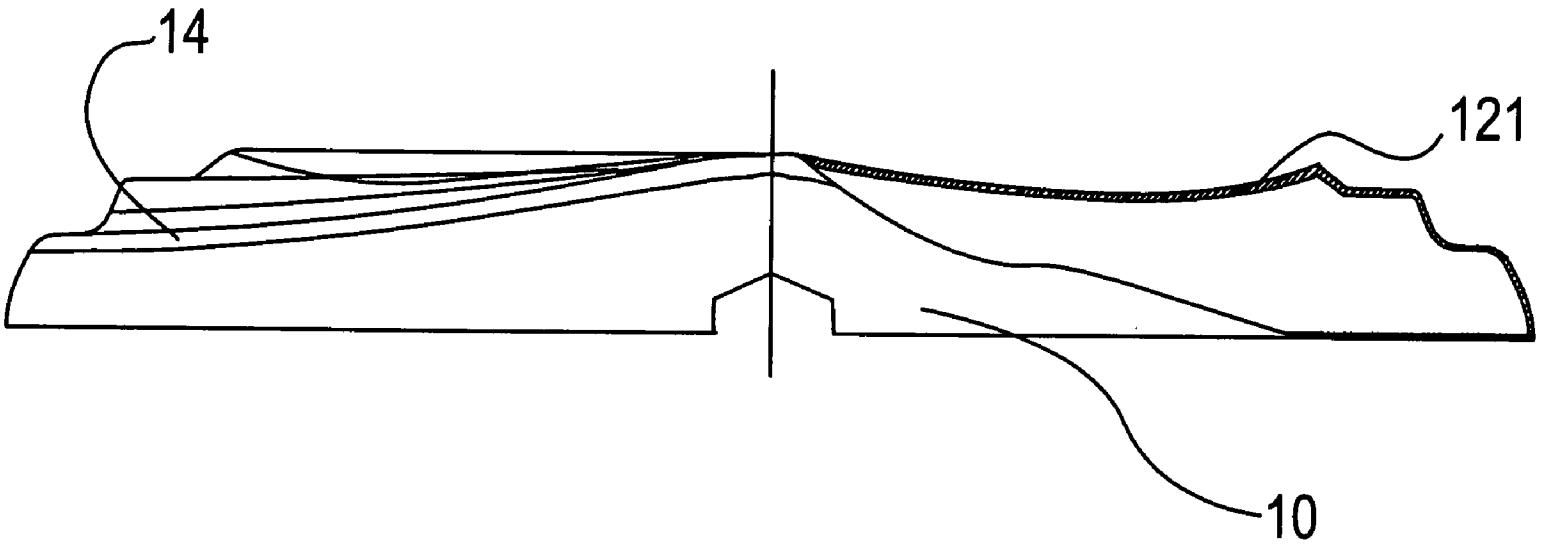
FIG. 3 is the cross section view of curved trough for the present invention.
Figure 4:
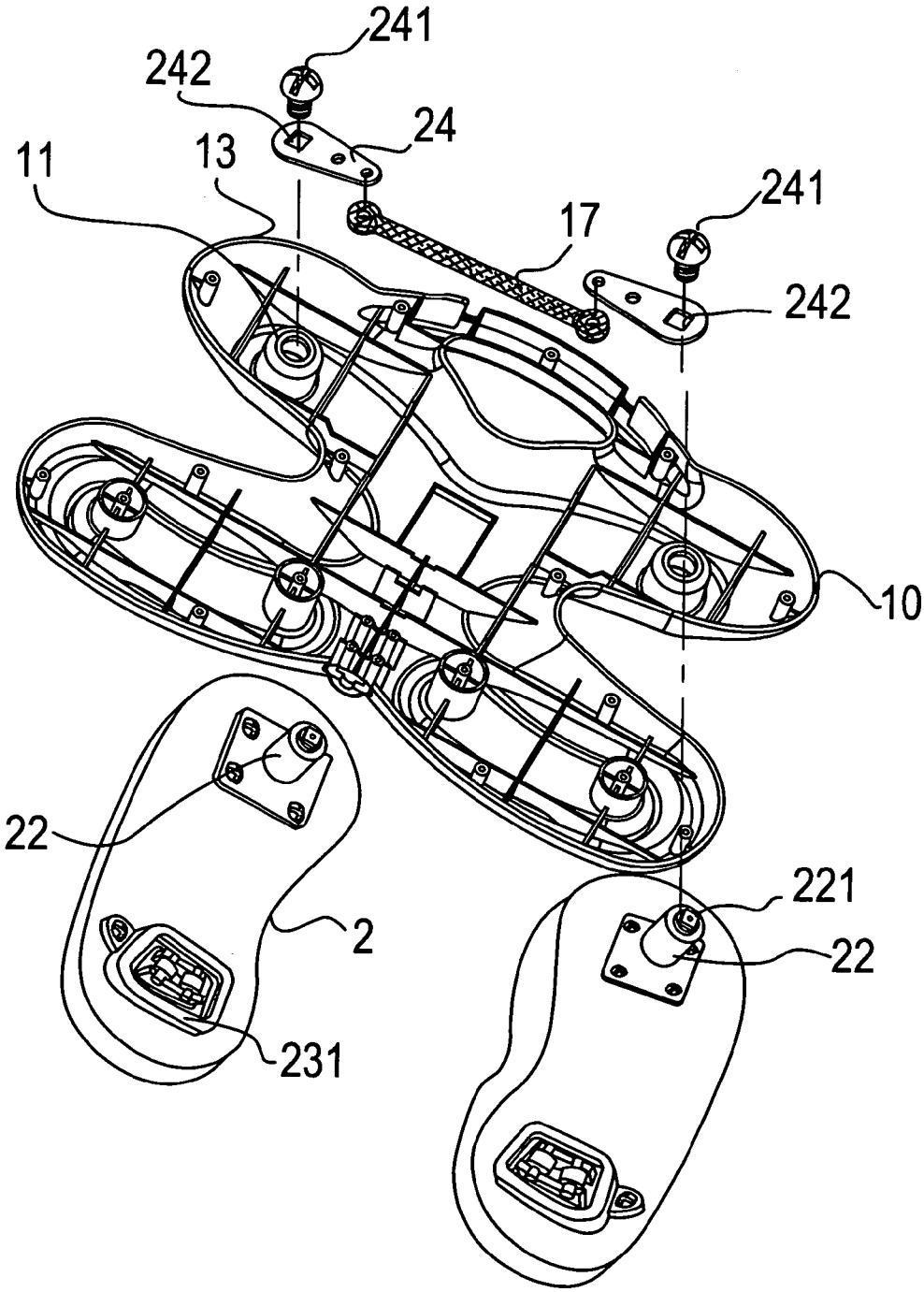
FIG. 4 is the exploded view showing the internal structure of the deck cover for the present invention.

Please refer to the FIGS. 1 to 7, which are the exploded and combinational illustrative views showing the structures of the "hip training apparatus" for the present invention.

The "hip training apparatus" comprises a chassis 1 and a pair of pivotable treadles 2, wherein, said chassis 1 includes a deck cover 10 and a soleplate 10'. At the both front sides of the deck cover 10, two symmetrical perforated holes 11 are configured for holding each of two pivotable treadles 2 therein; at the breech portion of the deck cover 10, one ramp 14 is symmetrically formed at each left and right side descending from the central line outwards laterally such that one curved trough 12 with curved track 121 therein is configured at each ramp 14.

Figure 9:
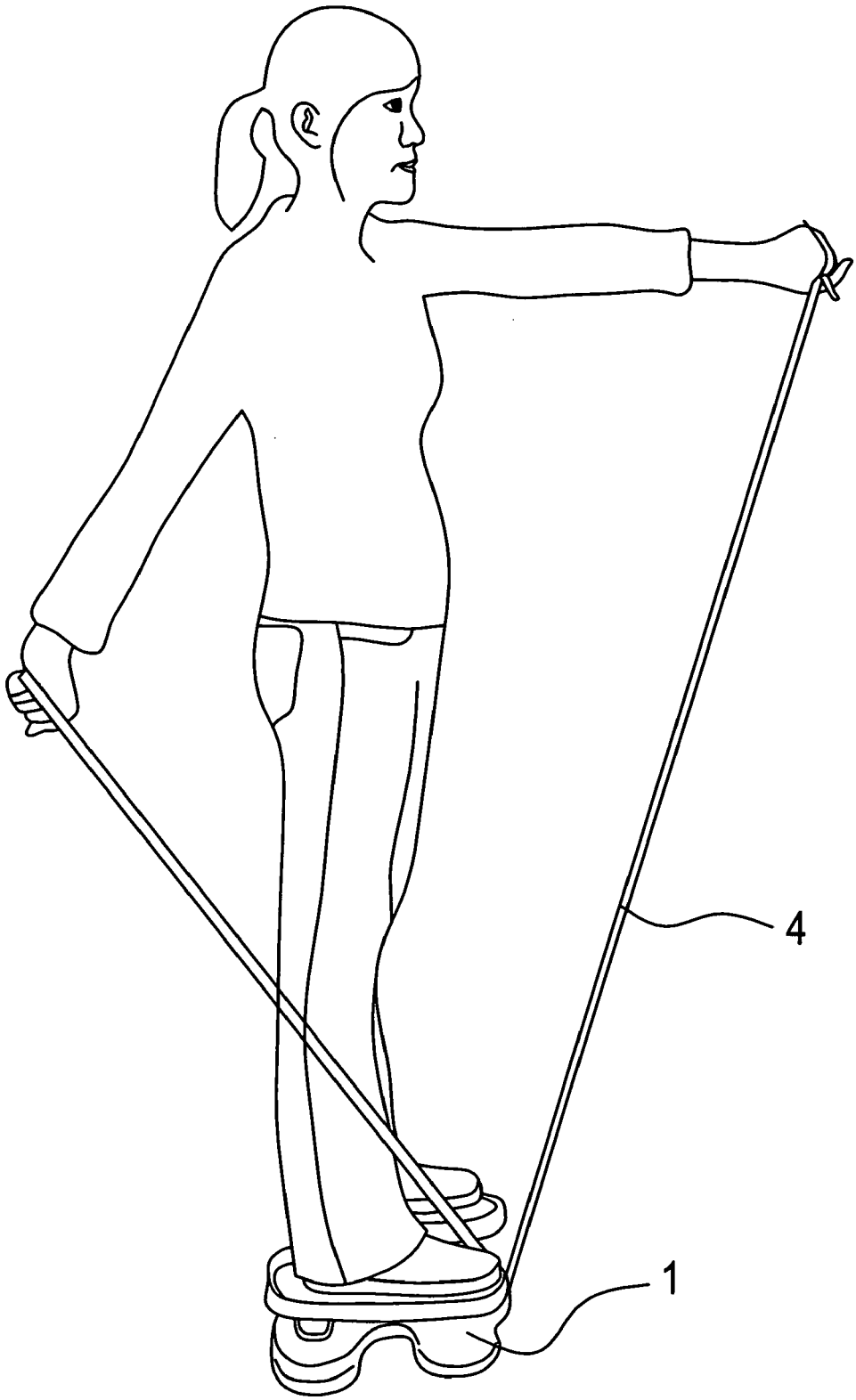
FIG. 9 is the illustrative view showing the operational status of the other elastic strap for the present invention.

For the purpose of enabling the user to carry the "hip training apparatus" on if necessary, at the front rim of the chassis 1, a carrying handle 13 is built on the deck cover 10 such that an aperture 131 with two lateral symmetrical slits 132 are configured thereon for having an elastic strap 4 (Please refer to FIG. 9 to FIG. 11) passed inside the aperture 131 with two ends staying outside of the slits 132 for user to grasp; at the rear rim of the deck cover 10 for the chassis 1, an adjusting wing nut 15 is built on the deck cover 10.

Said pair of pivotable treadles 2, which are symmetrically pivot juxtaposed on the chassis 1, have plural nipple studs 21 formed on the top surface so as to correspond to the plantar reflective acupuncture points for both of physiological massaging to the plantar tissue and supporting the anti-slipping friction during inwards pressing exercise by two feet of the user. At the front end and rear end of each back side of the pair of pivotable treadles 2 are a pivot axle 22 and a roller 23 respectively, which is securely fixed on the bottom thereof by a fitting frame 231 and a spring cushion 232. At the heel holding position of the rear end around each said pivotable treadle 2, an arched heel aligning ledge 25 is erected for enabling the user to perform inwards pressing exercise by two feet. Because the size of human sole is different from person to person, only heel holding position instead of toe holding position, the heel aligning ledge 25 is formed thereon to avoiding the confinement of the toe holding position, which is different from person to person due to different sole size.

During assembly, each pivot axle 22 of the pivotable treadle 2 is firstly set in each corresponding perforated holes 11 for deck cover 10 of the chassis 1 so that each roller 23, which is disposed on the pivotable treadle 2 with a spring cushion 232, is just lodged in each corresponding curved trough 12 of the deck cover 10. Then, each locking bore 242, which is to set on the joint lever slat 24 at the sole of the deck cover 10, is securely fitted and locked on each corresponding pivot peg 221 on the pivot axle 22 at the bottom of the pivotable treadle 2 by each locking screw 241 so that each pivotable treadle 2 can do pivotal movement in ascending inwards back and forth manner with each pivot axle 22 as center in each corresponding prefabricated curved track 121 of the curved trough 12 on the deck cover 10.

Figure 5:
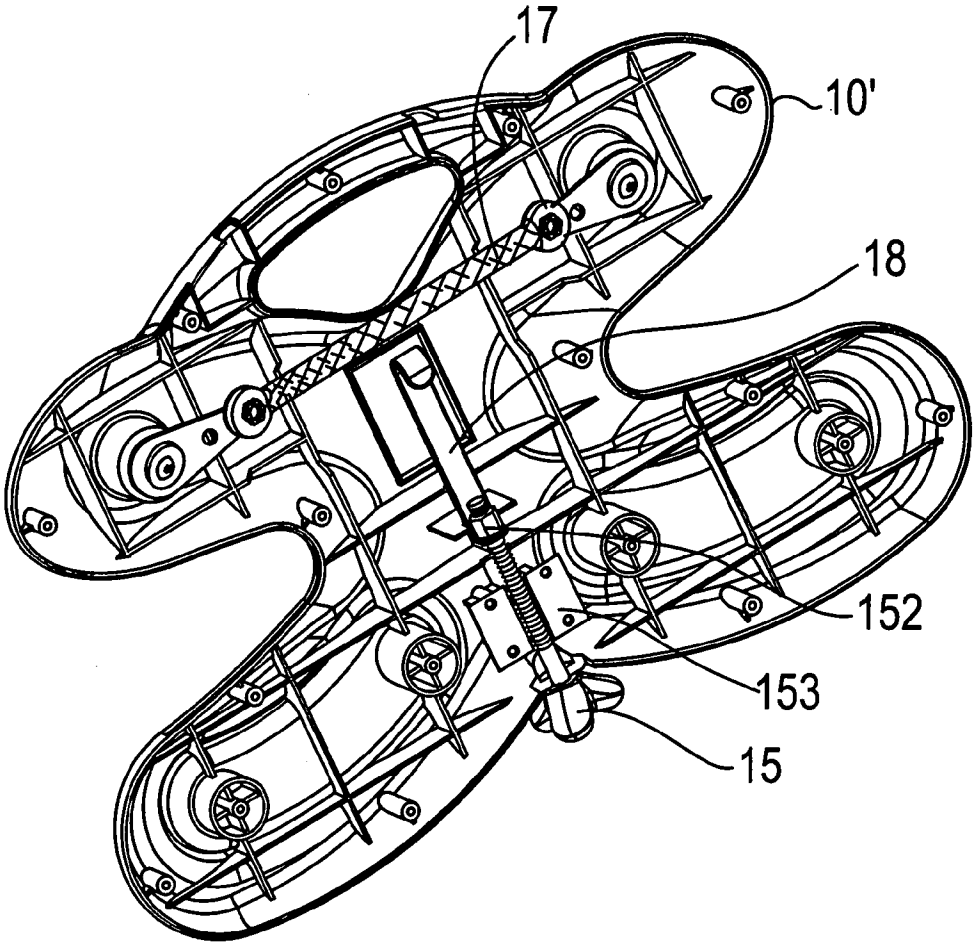
FIG. 5 is the combinational view showing the internal structure of the soleplate for the present invention.
Figure 6:
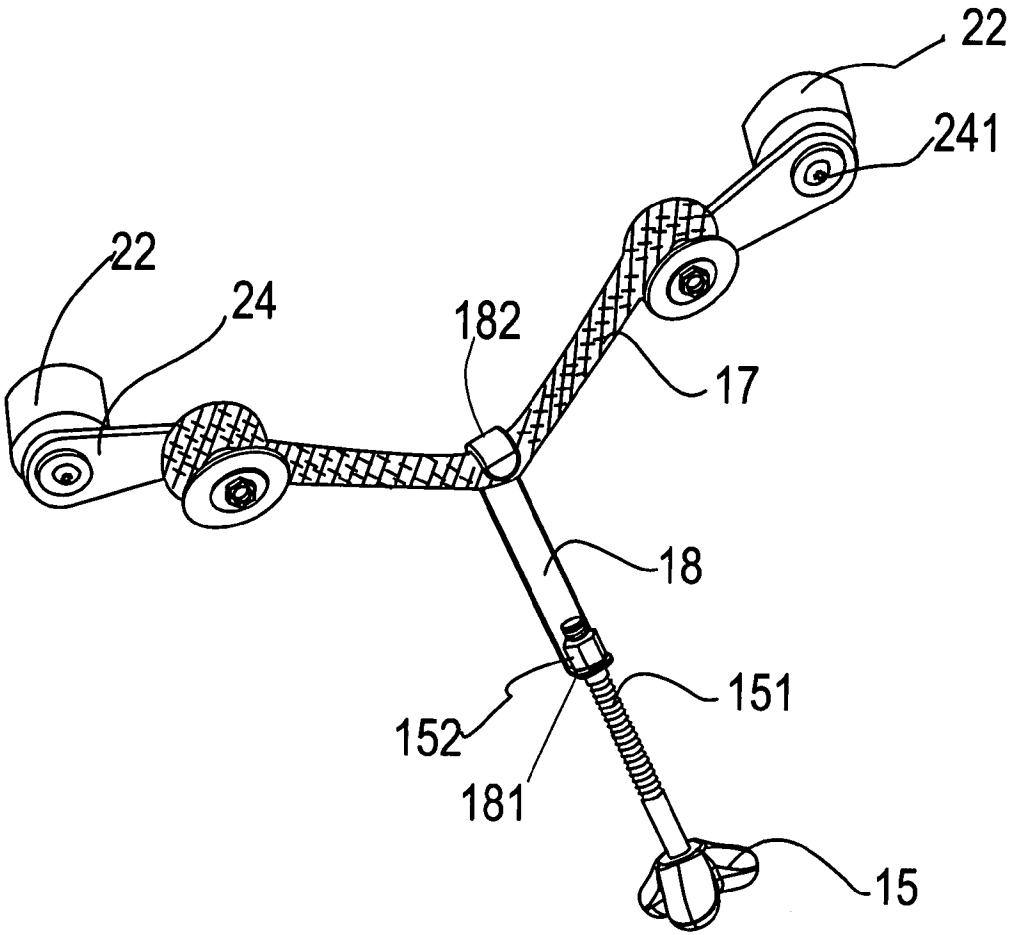
FIG. 6 is the schematic view showing the adjusting mechanism of the elastic belt for the present invention.
Figure 7:
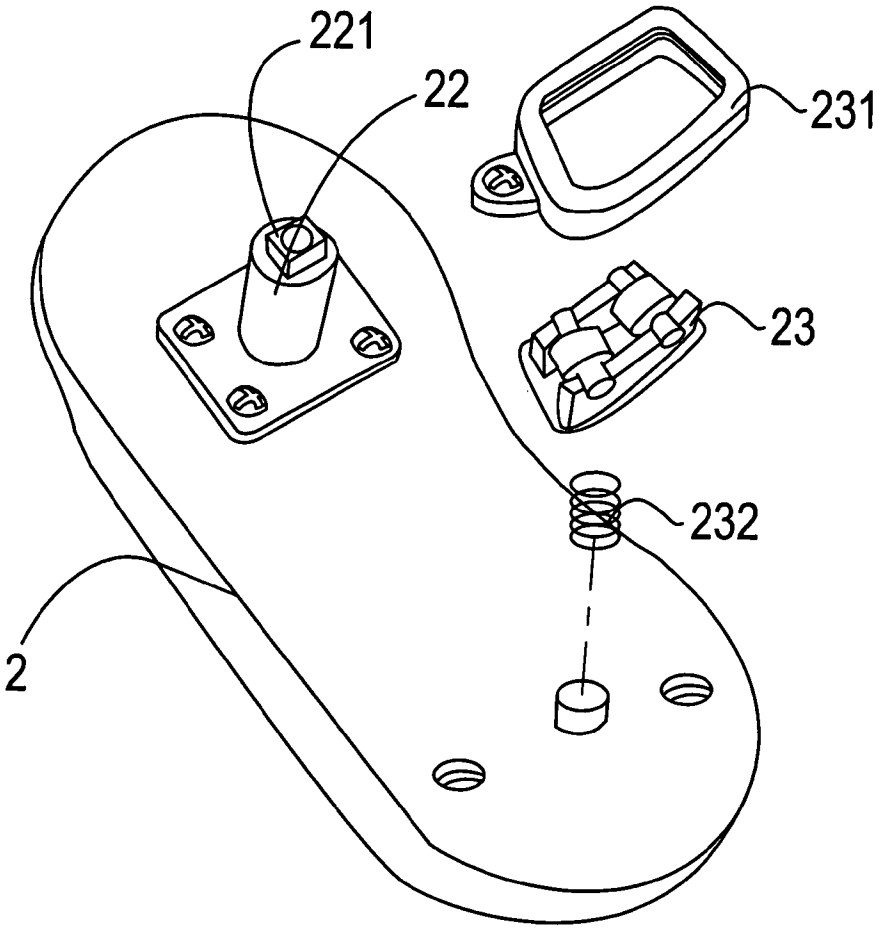
FIG. 7 is the exploded view showing the back structure of the pivotable treadle for the present invention.
Figure 8:
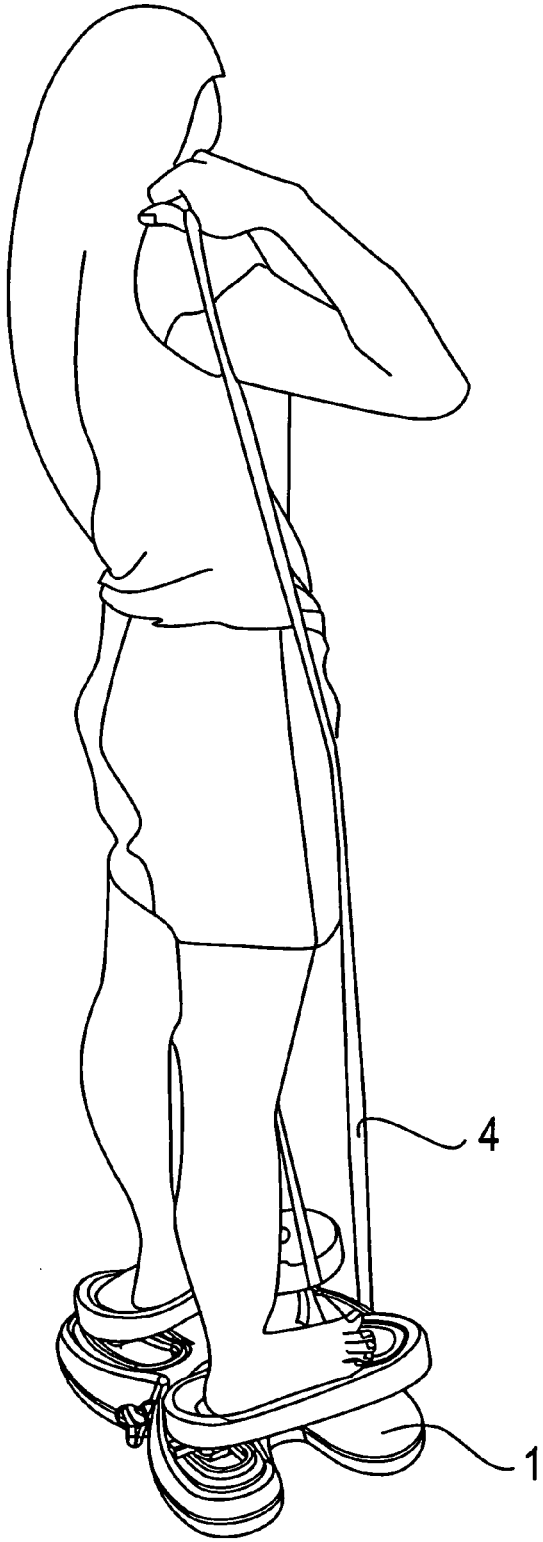
FIG. 8 is the illustrative view showing the operational status of the elastic strap for the present invention.

Please refer to the FIGS. 5 and 6, the both ends of the elastic belt 17 is secured on the joint lever slats 24. By suitably turning the adjusting wing nut 15, which drives the nut 152 via threaded rod 151 interconnecting the front bored angle piece 181 of the J-shape hook slat 18 in and out via associated threaded rod 151, the rear hook end 182 of the J-shape hook slat 18 will accordingly pull and release the middle section of the elastic belt 17 transversely for turning the joint lever slats 24 connected so that torsional tension exerting on two pivotable treadles 2 is altered in gradient manner accordingly; wherein, the nut 152 on the threaded rod 151 is used as tension adjuster and a holding plate 153 is disposed beneath the threaded rod 151 for preventing it from bounce due to exceeding pulling force.

Please refer to FIGS. 1 to 9, which are the operational views for the "hip training apparatus" of the present invention. During operation, each foot of the exerciser stands on each corresponding pivotable treadle 2 of the chassis 1 with heel abut with the heel aligning ledge 25 over the roller 23 and performs inwards pressing exercise by two feet simultaneously so that each pivotable treadle 2 follows the foot movement doing pivotal movement in ascending inwards back and forth manner in the curved trough 12 on the deck cover 10 with each pivot axle 22 as center. During non-operation status, both rear ends of the pivotable treadles 2 are borne the torque to laterally outmost position because the pivot axle 22 at the bottom front end of the pivotable treadle 2 is pulled by the elastic belt 17. Therefore, the greater is the tension of the elastic belt 17, the more exerting effort is required by the exerciser to draw the two pivotable treadles 2 together so as to enhance the hip training. Moreover, to only turn the adjusting wing nut 15 on the chassis 1 in proper degree, the torsional tension of the pivotable treadles 2 can be suitably adjusted in gradient manner via pulling force of the J-shape hook slat 18, which being driven by the connected nut 152 with threaded rod 151, acting on the elastic belt 17 with two pivotable joint lever slats 24. When the elastic belt 17 is pulled tightly, each end of both joint lever slats 24 is pulled towards the adjusting wing nut 15 so that the pivot peg 221 on the pivot axle 22 at the bottom of the pivotable treadle 2 is borne the torque from the connected locking bore 242 of the joint lever slat 24. Thereby, both rear ends of the pivotable treadles 2 follow the torque being tensely twisted towards laterally; contrarily, when the elastic belt 17 is released loosely, the pivotable treadles 2 become more movable due to less of the torsional tension borne on the joint lever slats 24. Thus, the user can achieve the gradient adjustment in such way.

Figure 11:
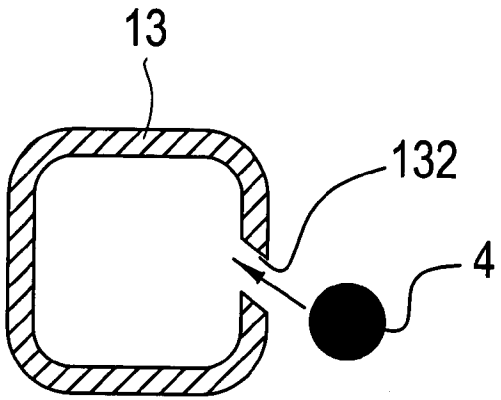
FIG. 11 is the cross section view showing the structure of the slit on the handle for the present invention.
Figure 10:
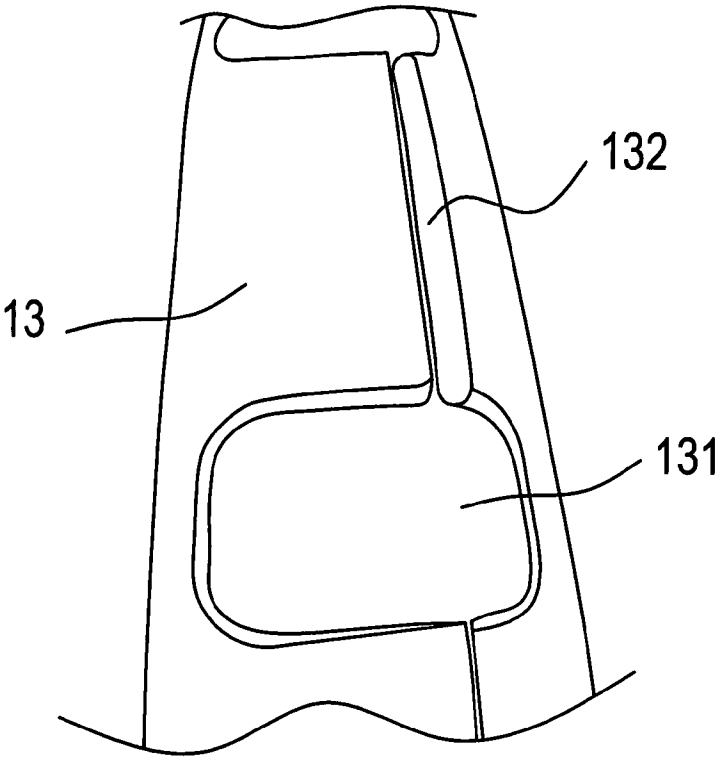
FIG. 10 is the illustrative view showing the structure of the aperture on the handle for the present invention.

Please further refer to the FIGS. 10 and 11, which show the structures of the aperture 131 and slit 132 on the handle 13. The stretchable elastic strap 4 is put in two apertures 131 via the associated slit 132 thereof. Because of the slant-cut shape in the slit 132, the elastic strap 4 is difficult to get off once it has been put in the carrying handle 13 so that the user can arbitrarily perform stretch and twist physical exercise with entire body in balance manner at will.

What is claimed is:

1. A hip training apparatus comprising:

a chassis having a deck cover and a soleplate, the deck cover having a centerline and one ramp being provided on the deck cover on a left of the centerline and one ramp being provided on the deck cover on a right side of the centerline, each ramp descends from the centerline laterally outwardly, each ramp having a curved trough with a vertically curved track therein, a pair of pivotable treadles, each ramp having a pivotable treadle associated therewith, each treadle having a pivot axle extending from a bottom side thereof, the deck cover having two holes and one of the pivot axles being received in one of the holes on the deck cover while another of the pivot axles being received in another of the holes on the deck cover, the two holes on the deck cover being on opposite sides of the centerline of the deck cover, joint lever slats being provided at ends of each of the pivot axles, the joint lever slats being located beneath the deck cover, each treadle having a roller which rides in the ramp during pivoting of the treadle;

an elastic belt interconnecting the joint lever slats, tension being applied to the joint lever slats via the elastic belt;

a J-shaped hook slat attached to the elastic belt, the J-shaped hook slat having a curved end and a straight body;

a threaded rod connected to the J-shaped hook slat, a longitudinal axis of the threaded rod being coextensive with a longitudinal axis of the body of the J-shaped hook slat such that the threaded rod and J-shaped hook body are linearly aligned;

a nut being adjustable secured to an end of the threaded rod opposite an end connected to the J-shaped hook slat, adjustment of the nut reciprocating the threaded rod and J-shaped hook slat to move and thereby stretch and release tension on the elastic belt to thereby vary tension applied to the pair of pivotable treadles;

the chassis having a front side and a rear side, a handle being provided on the front side of the chassis and the threaded rod with the nut extending from the rear side of the chassis, two openings being provided in the handle on the front side of the chassis;

an elastic strap which is mounted in the openings in the handle, the elastic strap being stretchable over at least one shoulder of a user for exercising; and the elastic belt is wrapped around projections at ends of the joint lever slats.

2. The hip training apparatus as recited in claim 1, wherein each pivotable treadle has a plurality of nipple studs formed on an upper surface thereof, the nipple studs being placed on the treadle corresponding to plantar reflective acupuncture points on a foot of a user.

3. The hip training apparatus as recited in claim 2, wherein an arched heel aligning ledge is located at a heel holding position at a rear end of each treadle.

4. The hip training apparatus as recited in claim 1, wherein the openings on the handle of the chassis are slant-cut shape.

5. The hip training apparatus as recited in claim 1, wherein a slit interconnects the openings on the handle of the chassis.

6. The hip training apparatus as recited in claim 1, wherein adjustment of the nut drives the threaded rod and the J-shaped hook slat forwardly and rearwardly relative to rear of the chassis, the curved end of the J-shaped hook slat being connected to a middle section of the elastic belt.

7. The hip training apparatus as recited in claim 5, further comprising a holding plate provided on an underside of the deck cover of the chassis, the holding plate engaging the threaded rod to prevent bouncing of the threaded rod.

* * * * *